United States Patent [19]

Galgana

[11] Patent Number: 4,972,998

[45] Date of Patent: Nov. 27, 1990

[54] METHOD AND SYSTEM FOR PREVENTING EXPLOSIONS WITHIN A SOLID WASTE DISPOSAL FACILITY

[75] Inventor: Russell J. Galgana, Clarksville, N.Y.

[73] Assignee: Smith & Mahoney, P.C., Albany, N.Y.

[21] Appl. No.: 384,490

[22] Filed: Jul. 24, 1989

[51] Int. Cl.[5] ..... B02C 25/00

[52] U.S. Cl. ..... 241/30; 110/193; 241/31; 241/34

[58] Field of Search ..... 241/DIG. 14, 30, 31; 110/222, 193, 185, 186, 347

[56] References Cited

U.S. PATENT DOCUMENTS 3,912,015 10/1975 Garbee et al. ..... 241/31 X
4,356,981 11/1982 Meadows ..... 241/31 X
4,712,741 12/1987 Uno et al. ..... 241/31 X

FOREIGN PATENT DOCUMENTS 2615931 12/1988 France ..... 110/193

OTHER PUBLICATIONS

Data Sheet No. 18-00-02, published by Mine Safety Appliances Company.
"The Gas Detection System Explained", by Bacharach.

*Primary Examiner*—Mark Rosenbaum
*Attorney, Agent, or Firm*—Hoffmann & Baron

[57] ABSTRACT

A method and a system are provided for preventing explosions within solid waste disposal facilities having a shredder, a shredder infeed conveyor, a shredder discharge conveyor, a trough conveyor, and a boiler. The system includes a gas sensor, a foam generator and associated nozzles, and gas dilution fans. The foam nozzles are positioned adjacent to the trough conveyor and are actuated when a signal is generated by the gas sensor. The foam acts as a fire and explosion break between the shredder and all subsequent areas of the facility.

21 Claims, 4 Drawing Sheets

METHOD AND SYSTEM FOR PREVENTING EXPLOSIONS WITHIN A SOLID WASTE DISPOSAL FACILITY

BACKGROUND OF THE INVENTION

The field of the invention relates to waste disposal systems for solid waste materials, and more particularly to a method and a system for preventing explosions within such systems.

Facilities for treating and disposing of solid waste materials have become increasingly important as available landfill sites continue to decline. Such facilities may include a receiving station for receiving the raw solid waste, a shredder for shredding the waste to a size which can more easily be combusted, and a boiler in which the shredded waste material is combusted. The energy generated by the boiler can be used to drive a steam turbine to provide electricity and/or to provide steam for industrial use. A magnetic separator is preferably provided between the shredder and the boiler to remove ferrous metals from the shredded waste materials. Recyclable materials and materials not suitable for routine shredding are preferably removed between the receiving station and the shredder.

The generation of combustible gases within certain facilities is a recognized problem, and has generally been addressed through the use of gas detectors, exhaust fans, foam generators, and system shut-off mechanisms. Combustible gases such as methane and other hydrocarbon gases within solid waste disposal systems are also a problem, particularly in view of the fact that such systems include incinerators which can trigger an explosion. While exhaust fans are helpful in preventing or delaying the development of a hazardous situation, they cannot be entirely relied upon to provide a solution to the problem. Indiscriminate application of water, foam or other substances would also be ineffective due to the large sizes of waste disposal systems. There is accordingly the need for a system for preventing explosions within a waste disposal facility in an efficient and effective manner.

SUMMARY OF THE INVENTION

It is an object of the invention to provide a system for preventing explosions within a solid waste disposal facility of the type which includes a boiler or other equivalent combustion means for incinerating shredded solid waste material.

It is another object of the invention to provide a system which is capable of operation in stages depending upon the levels of combustible gases which are detected.

In accordance with these and other objects of the invention, a solid waste disposal facility is provided which includes a system for preventing explosions therein. The facility includes a shredder and a conveyor for transporting shredded solid waste material from the shredder to a boiler or other places within the facility. The explosion prevention system includes means for detecting the presence of combustible gases within the facility, means for applying a combustion-suppressing substance to the conveyor, and means responsive to the detecting means for actuating said means for applying a combustion-suppressing substance.

The solid waste disposal facility is also provided with an infeed conveyor for transporting solid waste to the shredder. Means responsive to the detecting means are provided for stopping the infeed conveyor upon detection of a selected combustible gas concentration while allowing the other conveyor to continue transporting shredded solid waste material to the boiler. Combustible gas dilution fans are also provided within the facility and are actuated when the combustible gas or gas pressure exceeds a predetermined level.

A method for preventing explosions due to the presence of combustible gas, liquids and vapor/liquid laden solids is also provided. In accordance with this method, a dangerous level of combustible gases within the facility is sensed, the infeed conveyor to the shredder is stopped, and the conveyor between the shredder and boiler is sprayed with a combustion-suppressing substance such as foam. The foam is preferably sprayed by nozzles positioned adjacent to the conveyor, thereby providing an explosion and fire break which prevents the propagation of fire along the conveyor to the boiler or any other part of the facility.

DETAILED DESCRIPTION OF THE INVENTION

Figure 1:
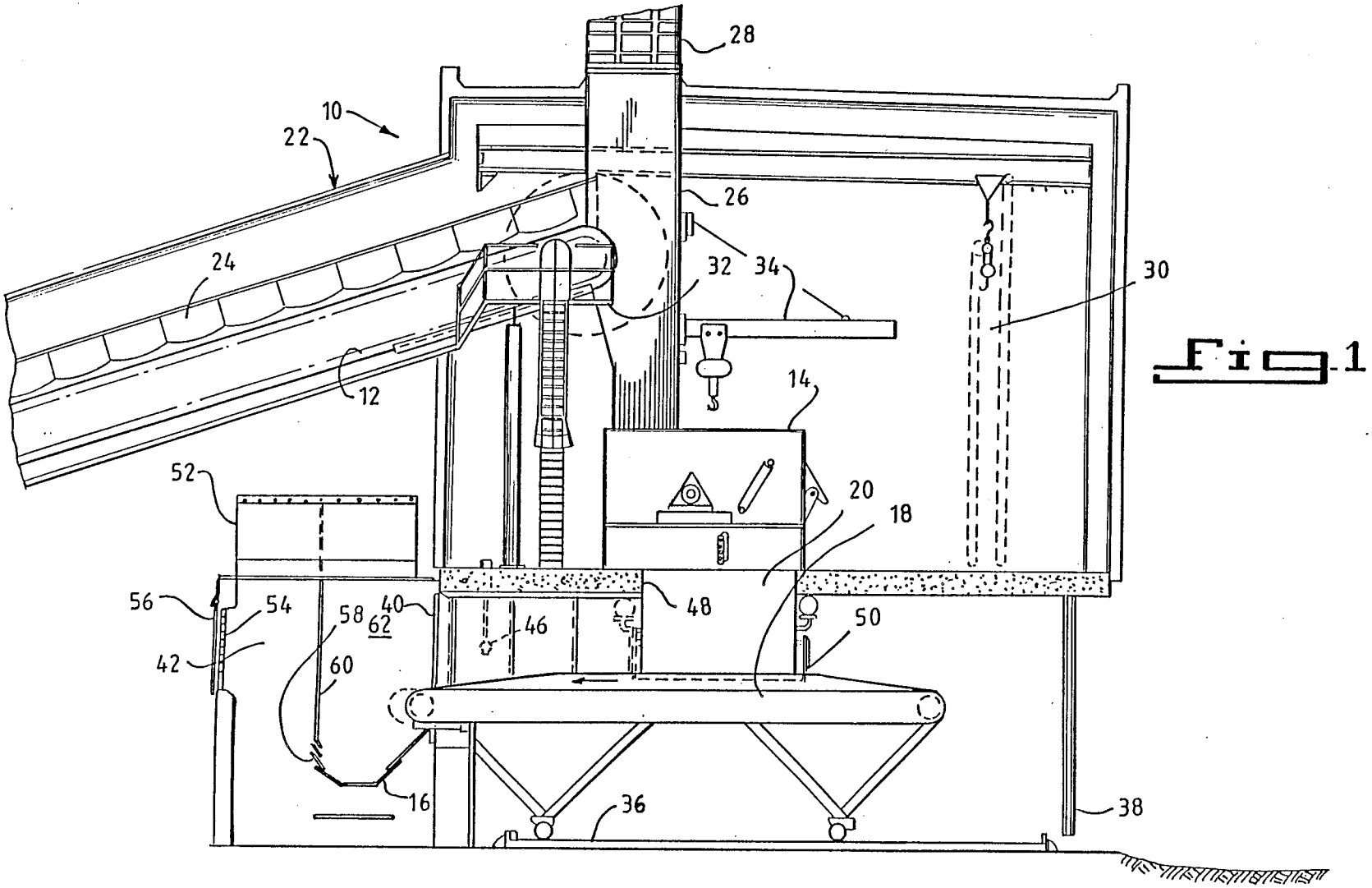
FIG. 1 is a side elevation view of a portion of a solid waste disposal and combustible gas detection system in accordance with the invention.

A solid waste disposal system including an explosion prevention system is provided by the invention. FIG. 1 illustrates a portion of a solid waste disposal system 10 which includes a shredder infeed conveyor 12, a shredder 14, and a trough conveyor 16 for conveying shredded solid waste material to a boiler (not shown). A shredder discharge conveyor 18 is provided within an enclosure beneath the shredder discharge hopper 20 for transferring shredded waste material to the trough conveyor 16.

The infeed conveyor 12 is positioned within a gallery 22 and bounded on each side by skirtboards 24. This conveyor 12 is used for conveying the waste material from a receiving station (not shown) to the shredder 14. A picking platform (not shown) may be positioned between the receiving station and the shredder 14. Unshreddable materials may be removed from the infeed conveyor 12 at this platform.

The shredder 14 includes an infeed hopper 26 having a vented upper end to which an explosion vent cage 28 is mounted. Solid waste material is fed to the hopper 26 by the infeed conveyor 12 and is shredded within the shredder 14. The shredder is located within a shredder building 30. A walkway 32 is provided within the building 30 for providing access to the discharge end of the infeed conveyor 12. A maintenance crane 34 is also positioned within the building and secured to the infeed hopper 26.

The shredder discharge conveyor 18 is mounted upon tracks 36 so that it may be moved between an operating position as shown in FIG. 1 and a retracted position. The latter position is preferred for performing maintenance and repair work. A rubber curtain 38 is suspended near one end of the track. At least one bulkhead door 40 is mounted to a conveyor shed 42 which houses the trough conveyor 16. The door 40 has a lower end adjoining the discharge end of the shredder discharge conveyor 18. The door is slidable with respect to the shredder discharge conveyor and closes the opening from the shredder discharge enclosure to the conveyor shed 42 when this conveyor is moved to the retracted position. Tracks (not shown) are provided for mounting the doors. A gas sensor 46 is suspended from the floor 48 of the shredding building for detecting the presence of dangerous combustible gases. The sensor is used in conjunction with a warning and shut-down system which will be described in greater detail below. It is positioned where dangerous combustible gases are most likely to be generated in sufficient amounts to cause an explosion, and where such gases can first be detected. By positioning the trough conveyor in the shed 42, it is kept separate from the shredder discharge area, and the concentration of combustible gases in the shed will at least temporarily be lower than that which may arise in the shredder discharge area. Corrective action may accordingly be possible before the gas is ignited. Dust control beneath the shredder discharge hopper 20 is enhanced by the provision of a dust cover 50 secured to the bottom end thereof.

Figure 2:
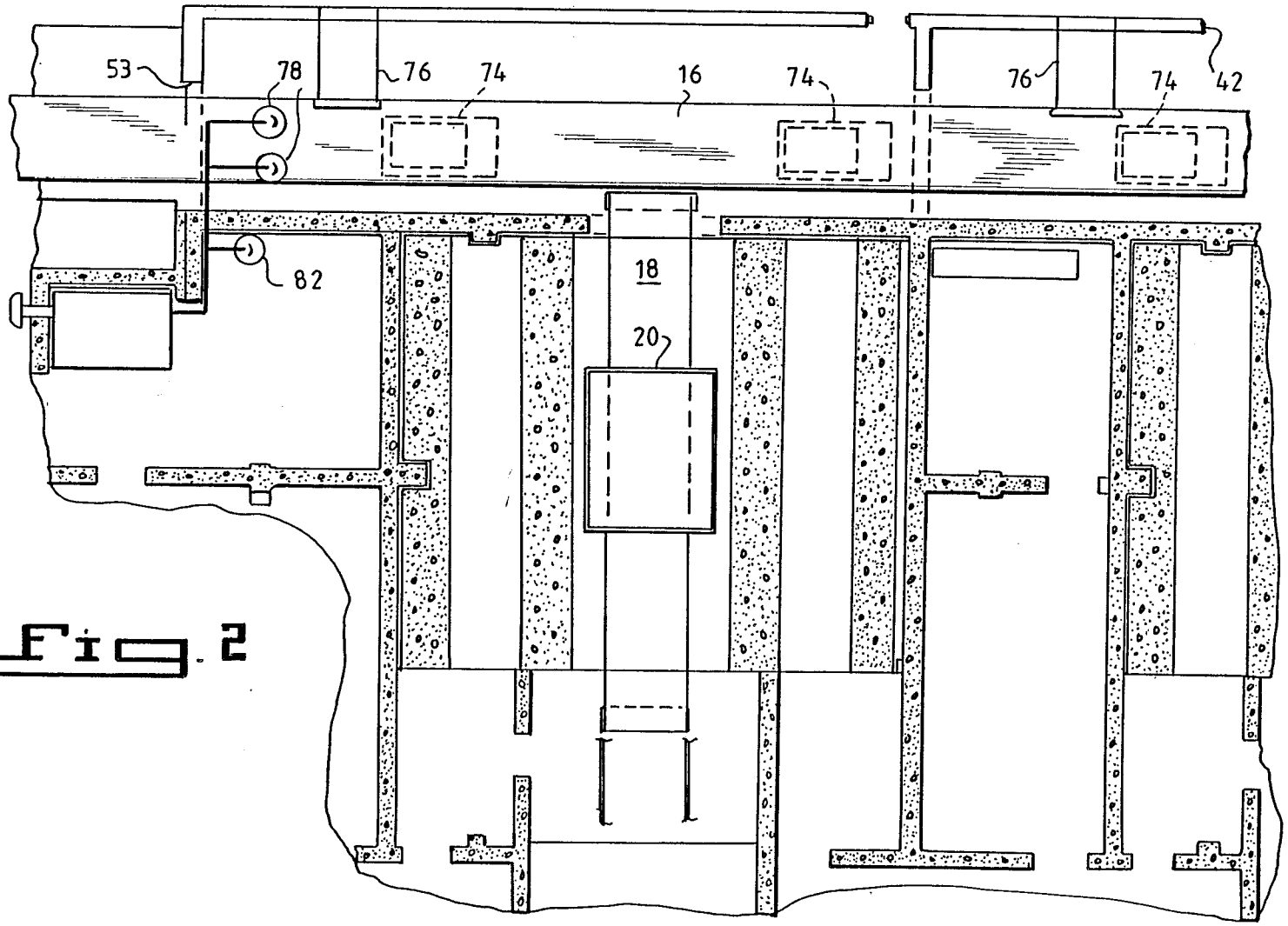
FIG. 2 is a top plan view of a portion of the lower level of a waste disposal system in accordance with the invention.

The conveyor shed 42 includes a plurality of explosion vents 52, each of which is defined by rubber flaps. The explosion vents may also include internal baffles. Depending upon how many shredders 14 are employed in the waste disposal system, the conveyor shed includes an appropriate number of bulkhead doors 40 to provide access to the trough conveyor 16. Referring to FIG. 2, the shed also includes an opening 53 through which the trough conveyor passes as it leaves the conveyor shed and proceeds to a magnetic separator and on to a boiler.

Referring again to FIG. 1, the conveyor shed 42 includes a grating 54 provided in a side wall thereof and flaps 56 which ordinarily cover the grating. The flaps 56 and explosion vents 52 are designed to minimize the effects of any explosions which may occur within the system should methane or other explosive gases be ignited.

A pair of continuous skirtboards 58 are provided on each side of the trough conveyor 16. Continuous strip curtains 60 are lapped inside the skirtboards 58. The trough conveyor 16, the strip curtains 60 and the top portion of the conveyor shed 42 define a dust plenum 62 which effectively confines dust generated by the shredded waste material.

Figure 1A:
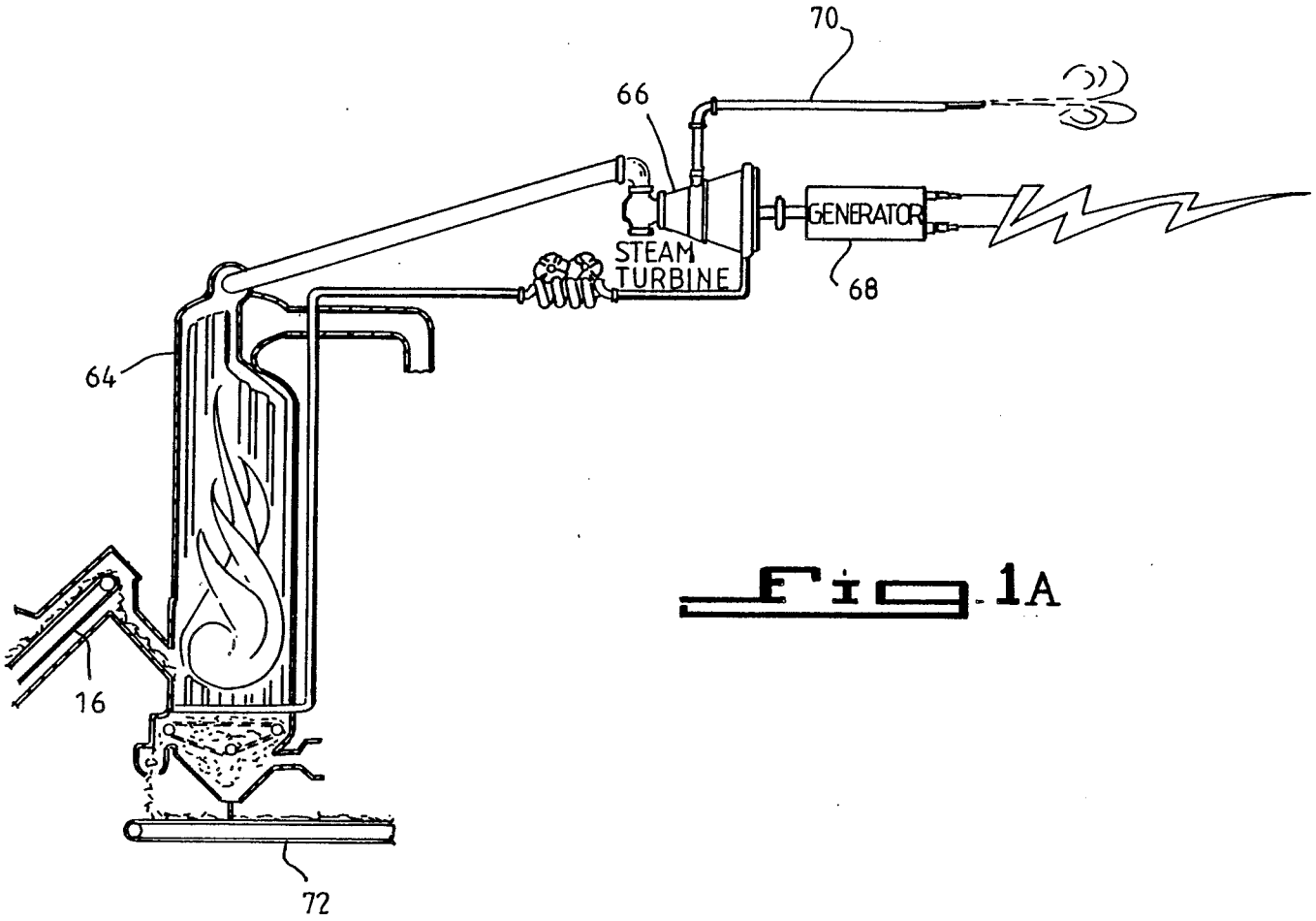
FIG. 1A is a schematic illustration of the portion of the waste disposal system which receives and incinerates shredded solid waste material.

As shown in FIG. 1A, shredded waste material is conveyed by the trough conveyor 16 to a boiler 64 in which it is incinerated. It will be appreciated that the trough conveyor 16 may include more than one section for transporting the waste material from the shredder to the boiler, to a magnetic separator, or to other points away from the shredder. As shown in FIG. 2, the trough conveyor passes through an exit opening 53 in the shredder building. The boiler is located in a separate building (not shown). The boiler may be used for driving a steam turbine 66 to power a generator 68 for producing electricity. Excess steam may be transported through a pipe 70 and used for industrial purposes. Bottom ash may be removed by a conveyor 72 and processed or disposed of.

As shown in FIG. 1, the gas sensor 46 is located slightly above the trough of the shredder discharge conveyor 18. Gas sensors have been widely utilized in industrial facilities for detecting combustible gases and toxic vapors. The structure of the particular gas sensor employed in the shredder discharge area forms no part of the present invention. A number of commercially available gas sensors would provide satisfactory results in the system disclosed herein.

Referring to FIG. 2, a portion of the trough conveyor 16 is shown in relation to one of the shredder discharge conveyors 18 within the facility. Dust collectors 74 are mounted directly above the trough conveyor. Combustible gas dilution fans 76 are also mounted above the trough conveyor. These fans are actuated by the gas sensors 46 within the facility.

Figure 3:
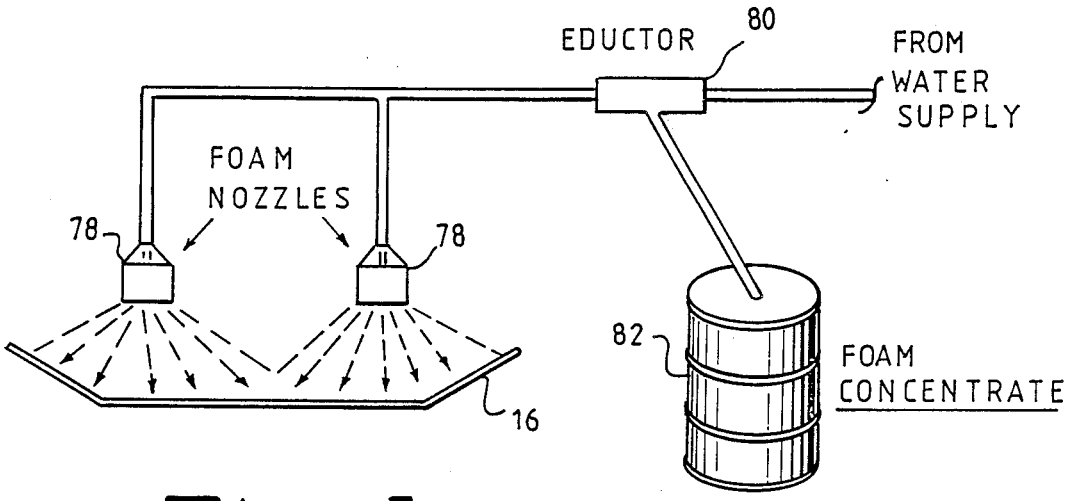
FIG. 3 is a schematic illustration of a foam suppression system used in accordance with the invention.

Foam nozzles 78 are mounted just above the trough of the trough conveyor 16, as best shown in FIG. 3. The nozzles are also positioned near the discharge end of the trough conveyor, i.e., near the exit opening 53 of the conveyor shed 42. The nozzles are supplied with a mixture of water and foam concentrate by means of an eductor 80. The concentrate, preferably soap and/or other suitable material (e.g. anionic surfactants) used to extinguish fires, is stored within one or more tanks 82.

For a trough conveyor having a width of about six feet, a 45-gpm eductor is employed which produces 1500 cfm of foam. Water is supplied at a rate of about 45 gpm while the eductor adds about 1.0 gpm of foam concentrate.

Figure 4:
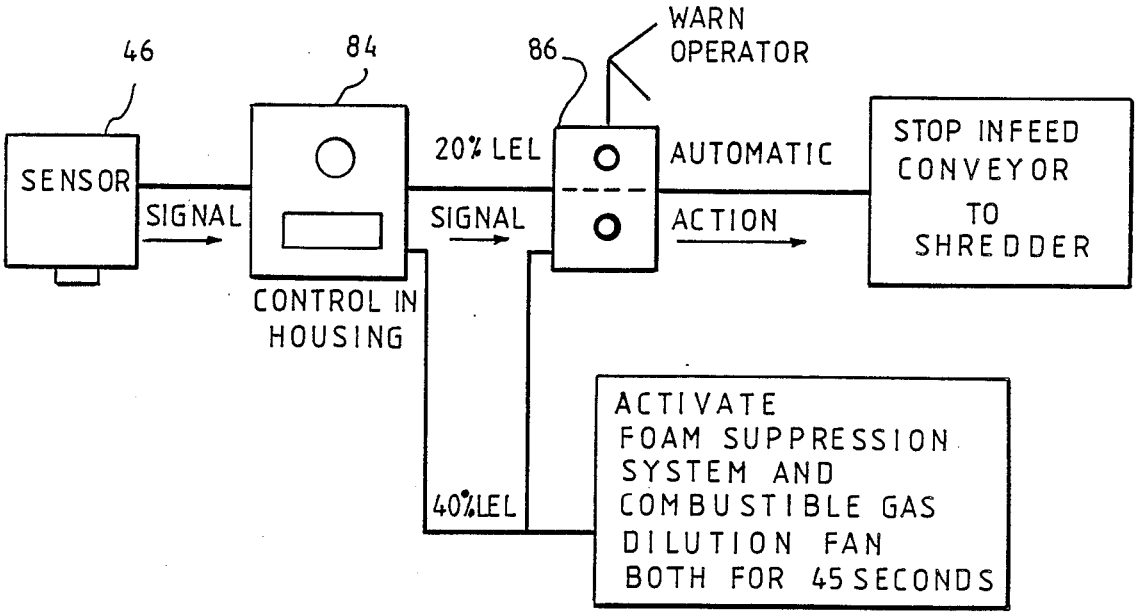
FIG. 4 is a schematic illustration of an explosion prevention system according to the invention.

As shown in FIG. 4, a control assembly 84 is provided for controlling the operations of the shredder infeed conveyor 12, an alarm system 86, the foam suppression system, and the combustible gas dilution fans 76. Under normal operating conditions in a solid waste disposal facility, the gas concentration is below 20% of the lower explosive limit (L.E.L.) and no signals from the gas sensor 46 are received by the control assembly 84 which require action to be taken. As a precautionary measure, the shredder 14 cannot be started unless the gas detection system is on.

The control assembly 84 activates the various emergency control procedures in two stages. When the gas concentration reaches 20% L.E.L., the infeed conveyor 12 is stopped and a horn (not shown) and light (not shown) are actuated in a control room and/or other appropriate locations. At 40% L.E.L., the foam suppression system and the combustible gas dilution fans 76 are both actuated by the control assembly 84 for 45 seconds. The 45 second period is sufficient to allow all potentially explosive vapors, liquids, and vapor/liquid laden solids to clear the shredder 14 following the infeed conveyor stoppage initiated at 20% L.E.L. The cycle repeats automatically if the 40% L.E.L. condition still exists after the initial 45 seconds has expired.

The strategic placement of the foam nozzles allows the foam to act as an explosion and fire break. Fire is effectively prevented from traveling along the trough conveyor 16 to a point where it could initiate an explosion in any other areas of the facility wherein dangerous concentrations of combustible vapors may have accumulated.

Various other safety mechanisms can be incorporated within the solid waste disposal system. The emergency procedures can be activated manually from the control room or other appropriate location.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A solid waste disposal system comprising:
a shredder;
means for incinerating shredded solid waste material;
first conveyor means for transporting solid waste material to said shredder;
second conveyor means for transporting shredded solid waste material from said shredder to said means for incinerating;
means for detecting the presence of combustible gases; and
means responsive to said detecting means for applying a fire-suppressing material to said second conveyor means.

2. A system as defined in claim 1 including a shredder building, said shredder and at least part of said second conveyor means being located within said shredder building.

3. A system as defined in claim 2 wherein said applying means includes foam generating means.

4. A system as defined in claim 3 wherein said shredder includes an outlet adjacent said second conveyor means, said detecting means being positioned near said shredder outlet.

5. A system as defined in claim 3 including means responsive to said detecting means for stopping said first conveyor means.

6. A system as defined in claim 3 including combustible gas dilution fans, and means responsive to said detecting means for actuating said fans.

7. A system as defined in claim 1 including a boiler for incinerating shredded solid waste material, said second conveyor means extending between said shredder and said boiler.

8. A system as defined in claim 7 wherein said applying means includes foam generating means.

9. A system as defined in claim 8 wherein said shredder includes an outlet adjacent said second conveyor means, said detecting means being positioned near said shredder outlet.

10. A system as defined in claim 8 including means responsive to said detecting means for stopping said first conveyor means upon detection of a first level of, combustible gases, said means for applying a fire-suppressing material to said second conveyor means being actuable upon detection of a second level of combustible gases higher than said first level by said detecting means.

11. A system as defined in claim 1 including combustible gas dilution fans, and means responsive to said detecting means for actuating said fans.

12. A system as defined in claim 11 wherein said combustible gas dilution fans are positioned above said second conveyor means.

13. A system as defined in claim 1 wherein said second conveyor means includes a shredder discharge conveyor and a trough conveyor, said shredder discharge conveyor being positioned to receive shredded solid waste material from said shredder and to deposit said material upon said trough conveyor.

14. A system as defined in claim 13 including a first enclosure containing said shredder discharge conveyor and a second enclosure containing said trough conveyor, a first opening communicating said first enclosure with said second enclosure, said shredder discharge conveyor extending through said first opening.

15. A system as defined in claim 14 wherein said detecting means is positioned adjacent to said shredder discharge conveyor.

16. A system as defined in claim 15 wherein said second enclosure includes a second opening remote from said first opening, said trough conveyor passing through said second opening, said applying means including means for spraying said trough conveyor with a fire-suppressing material adjacent said second opening.

17. A system as defined in claim 1 including means responsive to said detecting means for stopping said first conveyor means when a first combustible gas concentration is detected and for actuating said applying means when a second combustible gas concentration higher than said first combustible gas concentration is detected.

18. A method for preventing explosions within a solid waste disposal facility including a shredder, an infeed conveyor for transporting solid waste material to said shredder, a boiler, and second conveyor means for conveying shredded solid waste material from said shredder to said boiler, comprising the steps of:
detecting the presence of a combustible gas within said facility,
stopping said infeed conveyor when a first concentration of combustible gases is exceeded, and
applying a fire-suppressing material to said second conveyor means when a second concentration of combustible gases higher than the first concentration of combustible gases is exceeded.

19. A method as defined in claim 18 wherein said fire-suppressing material is a foam.

20. A method as defined in claim 18 wherein said second conveyor means includes a shredder discharge conveyor positioned to receive shredded solid waste material from said shredder and a trough conveyor for receiving shredded waste material from said shredder discharge conveyor, including the step of detecting the presence of combustible gases adjacent said shredder discharge conveyor.

21. A method as defined in claim 20 wherein said foam is applied to said trough conveyor at a location remote from said shredder discharge conveyor.

* * * * *